US005913934A

United States Patent [19]

Inoue et al.

[11] Patent Number: 5,913,934

[45] Date of Patent: Jun. 22, 1999

[54] MULTIPLE-TERMINAL CRIMPING MACHINE

[75] Inventors: Toshihiro Inoue; Akira Sugiyama, both of Shizuoka; Hirokazu Akita, Yamagata; Ichio Igarashi, Yamagata; Masashi Suzuki, Yamagata, all of Japan

[73] Assignees: Yazaki Corporation, Tokyo; Japan Chain Terminal Co., Ltd., Kanagawa, both of Japan

[21] Appl. No.: 08/842,325

[22] Filed: Apr. 24, 1997

[30] Foreign Application Priority Data

Apr. 25, 1996 [JP] Japan ..... 8-105159
Feb. 28, 1997 [JP] Japan ..... 9-046623

[51] Int. Cl.[6] ..... B26D 5/08

[52] U.S. Cl. ..... 72/442; 72/446; 72/405.03; 29/748; 29/753

[58] Field of Search ..... 72/405.03, 442, 72/446, 447, 476, 477, 441; 29/748, 753

[56] References Cited

U.S. PATENT DOCUMENTS 3,184,950 5/1965 Sitz ..... 72/446
3,938,416 2/1976 Beauplat ..... 72/442
5,095,599 3/1992 Gloe et al. ..... 72/441
5,555,759 9/1996 Rosene et al. ..... 72/442

FOREIGN PATENT DOCUMENTS 5-226056 9/1993 Japan .

*Primary Examiner*—David Jones
*Attorney, Agent, or Firm*—Armstrong, Westerman, Hattori, McLeland & Naughton

[57] ABSTRACT

The crimping machine includes a crimper opposed to an anvil for crimping a stripped wire end to a terminal; a vertical rotation shaft axially secured on a base frame; a lower rotating base disc axially engaged with a lower end of the rotation shaft; an upper rotating base disc and a shank each axially slidably engaged with an upper end of the rotation shaft by way of a spline; and a flange formed at an upper end of the shank and engaged with a hook-shaped portion formed at a lower end of the pressing ram. The lower and upper discs have respectively a plurality of fitting channels radially extending from the rotation shaft. Each channel of the upper disc is detachably mounted with the crimper, and each channel of the lower disc is detachably mounted with the anvil. An adjusting dial for adjusting crimp height of the crimper is respectively provided in an outer surface of the shank. In place of the adjusting dial, there may be provided an adjusting disc adjusting crimp height of the crimper and having a plurality of positioning bosses with different vertical thicknesses.

10 Claims, 10 Drawing Sheets

MULTIPLE-TERMINAL CRIMPING MACHINE

BACKGROUND OF THE INVENTION

1. Field of the Invention

The present invention relates to a multiple-terminal crimping machine, for example, for crimping a stripped end of an electrical wire to a terminal to compose a wiring harness.

2. Description of the Prior Art

A wiring harness applied for electrical wiring in an automobile vehicle has been utilizing multiple terminals and electrical wires. Thence, crimping of these multiple terminals requires a crimping machine having an applicator corresponding to the types of terminals. Accordingly, in a terminal crimping process for a small quantity of but many types of terminals such as test sample terminals, each type of terminals requires respectively an applicator and a crimping machine. This causes the disadvantage of requiring a larger manufacturing cost and a broader installation space.

To eliminate the disadvantage, Japanese Patent Application Laid-open No. 5-226056 has proposed a terminal crimping apparatus S as shown in FIGS. 9 and 10.

This terminal crimping apparatus S has a base frame a for terminal crimping machines. The frame a supports axially a rotating shaft c of a rotating frame b having a plurality of the support arms $b_1$. Each of the support arms $b_1$ is pivotably jointed to respective cradles d with a pin shaft e. The cradle d has been detachably mounted with applicators f ($f_1$, $f_2$, . . . ) Consequently, rotation of the frame b allows to use selectively a desired applicator f corresponding to the type of the terminal.

The aforementioned terminal crimping apparatus S has the frame b having the plurality of support arms $b_1$ that rotates cradles d with respective applicators f around the rotating shaft c, which constituting a big wheel. Accordingly, the apparatus has been requiring a large mechanism and space for accommodating the applicators f, causing a drawback of difficulty in space reduction and in cost saving.

SUMMARY OF THE INVENTION

In view of the above-mentioned drawback, an object of this invention is to provide a multiple-terminal crimping machine easily prepared for various types of terminals and accomplishing minimization in size, reduction in installation space, and cost reduction.

For achieving the object, a multiple-terminal crimping machine according to a first characteristic aspect of the present invention includes:

a crimper and an anvil for crimping a stripped wire end to a terminal, the crimper being moved up and down by a pressing ram, the anvil being positioned opposite to the crimper;

a base frame for supporting the crimping machine;

a vertical rotation shaft axially supported on the base frame;

a lower rotating base disc axially engaged with a lower end of the rotation shaft;

an upper rotating base disc and a shank each axially slidably engaged with an upper end of the rotation shaft by way of a spline; and a flange formed at an upper end of the shank and engaged with a hook-shaped portion formed at a lower end of the pressing ram, wherein the lower rotating base disc and the upper rotating base disc have respectively a plurality of fitting channels radially extending from the rotation shaft, each of the channels of the upper rotating base disc being detachably mounted with the crimper, each of the channels of the lower rotating base disc being detachably mounted with the anvil opposed to the crimper.

In the above-mentioned crimping machine, the upper and lower rotating base discs attached to the rotation shaft have plural pairs of crimpers and anvils radially disposed thereon. This allows selective use of the crimpers and anvils in conformity with desired types of terminals. Further, the plural crimpers and anvils are detachably mounted and the crimpers can be moved vertically by a single pair of the ram and the shank, enabling simplified construction, minimization in size, reduction in space, and cost saving regarding the crimping apparatus.

According to a second feature of the invention, an adjusting dial for adjusting crimp height of the crimper is respectively provided in an outer surface of the shank. Thereby, turning the adjusting dial relative to respective crimpers corresponding to the type of the terminal allows easy adjustment of crimp height when the terminal is crimped.

A third feature of the invention further includes: an adjusting disc for adjusting crimp height of the crimper is axially engaged with the rotation shaft between the shank and the upper rotating base disc by way of the spline, the adjusting disc being engaged with the rotation shaft so as to intermittently rotate around the rotation shaft and having a plurality of position adjusting bosses radially formed on an outer periphery thereof, the adjusting disc also having a rotation stopper, the shank having a rotation preventing key engaging with the stopper when the shank is lifted, the adjusting disc being able to rotate together with the upper rotating base disc when the shank is lowered from the lifted position by the downward movement of the ram so that the stopper can be released from the key. Consequently, lifting the shank causes the rotation stopper to lock to the rotation preventing key. This allows the adjusting disc to be secured to the shank. Then, the upper and lower rotation base discs are turned so that a selected pair of the crimpers and anvils can align with a desired adjusting boss of the adjusting disc. Next, downward movement of the ram releases the stopper from the rotation preventing key, allowing the adjusting disc to turn together with the upper rotating base disc. As a result, the crimper and the anvil can be positioned at a desired location for terminal crimping. Thence, crimp height adjustment can be automatically accomplished by moving up and down the ram and by turning the upper rotating base disc. This eliminates turning the adjusting dial by hand, which being more advantageous than the second aspect of the invention.

According to a fourth feature of the invention, each of the anvils secured on the lower rotating base disc preferably has first and second terminal guides for a terminal fitting. This arrangement correctly guides the terminal fitting in its axial direction, eliminating defective products.

A fifth feature of the invention includes: the base frame has a base plate with a space thereunder and a pair of side plates; under the base plate is disposed a bearing fitting plate; between the base plate and the bearing fitting plate is axially rotatively mounted a jointing shaft rotatively connected to a servo-motor output shaft by way of a timing belt; and an upper end of the jointing shaft is connected to a lower end of the rotation shaft by a jointing key. That is, the crimping machine includes a rotation source section having the rotation shaft with the plurality of crimpers and anvils.

Further, the rotation source section is assembled separately from a terminal applicator section, enabling a simplified construction and a lower cost in machinery installation.

In a sixth characteristic aspect of the invention, the jointing shaft comprises an upper jointing shaft body and a lower jointing shaft body that are jointed by way of a parallel pin, the upper jointing shaft body being biased by a spring toward the rotation shaft. This surely accomplishes engagement of the rotation shaft with the jointing shaft, and synchronous rotation of the rotation shaft with the servo-motor.

According to a seventh feature of the invention, a driven shaft extending downward from the bearing fitting plate is axially rotatively supported by the bearing fitting plate and the base plate; the driven shaft connects to a supporting shaft for supporting a terminal accommodating box by way of a gear; the terminal accommodating box has a plurality of radially extending, terminal receiving chambers relating to a plurality of crimpers and anvils. This arrangement allows that each terminal receiving chamber accommodates a terminal fitting corresponding to a pair of crimpers and anvils, enabling correct supply of the terminal fittings to be crimped.

According to an eighth feature of the invention, the servo-motor output shaft for rotating the rotation shaft has a rotation angle detecting plate for detecting a rotated angle from a base line regarding each of the plurality of crimpers and anvils to serve as a rotation angle detecting shaft driving a driven shaft. This simple construction can easily select a desired one from the plurality pairs of crimpers and anvils so as to be fit for the type of the terminal and allows correct positioning thereof.

DETAILED DESCRIPTION OF THE PREFERRED EMBODIMENTS

Referring to the accompanying drawings, preferred embodiments of the invention will be discussed hereinafter.

Figure 1:
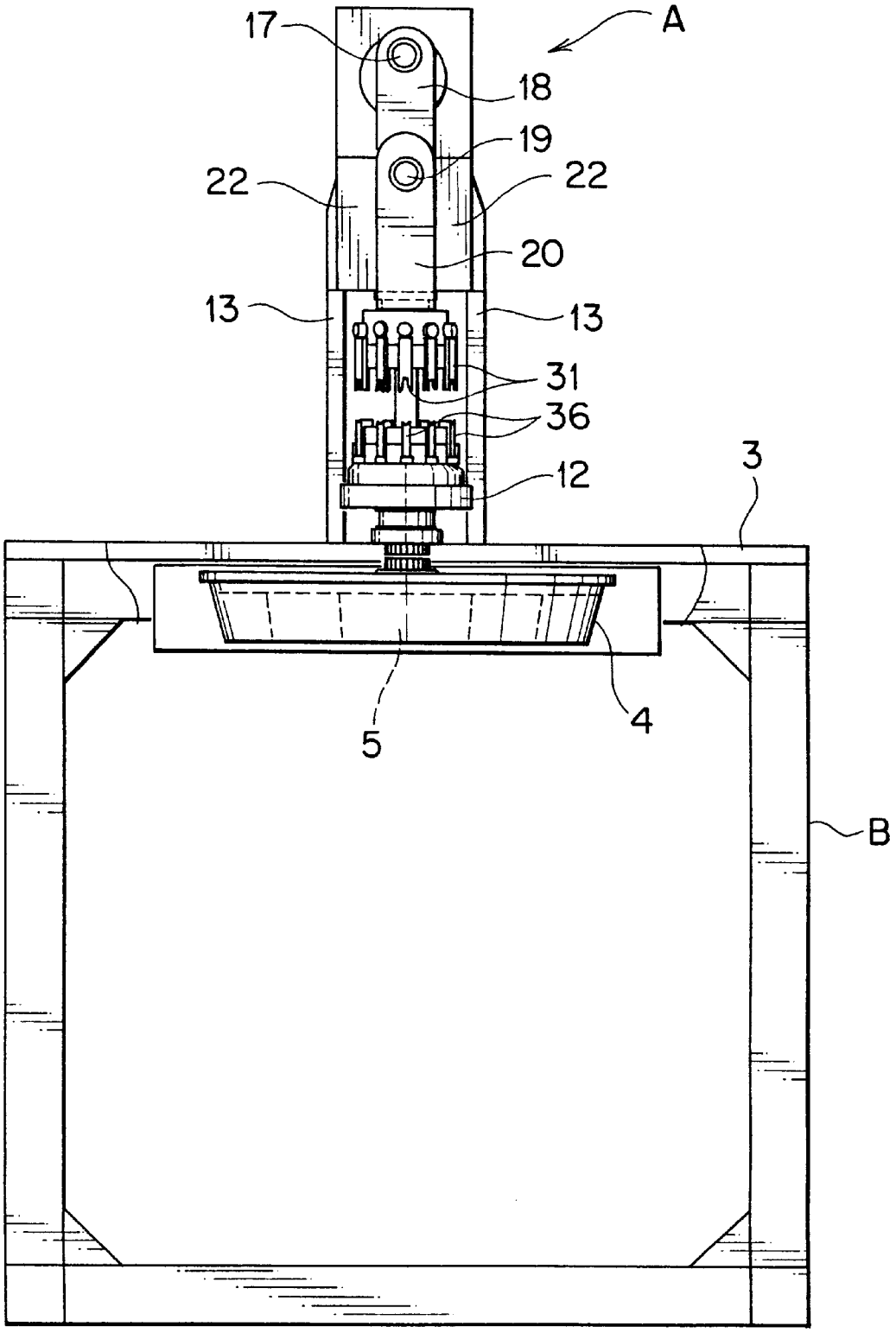
FIG. 1 is the front view showing a multiple-terminal crimping machine of an embodiment according to the invention.
Figure 2:
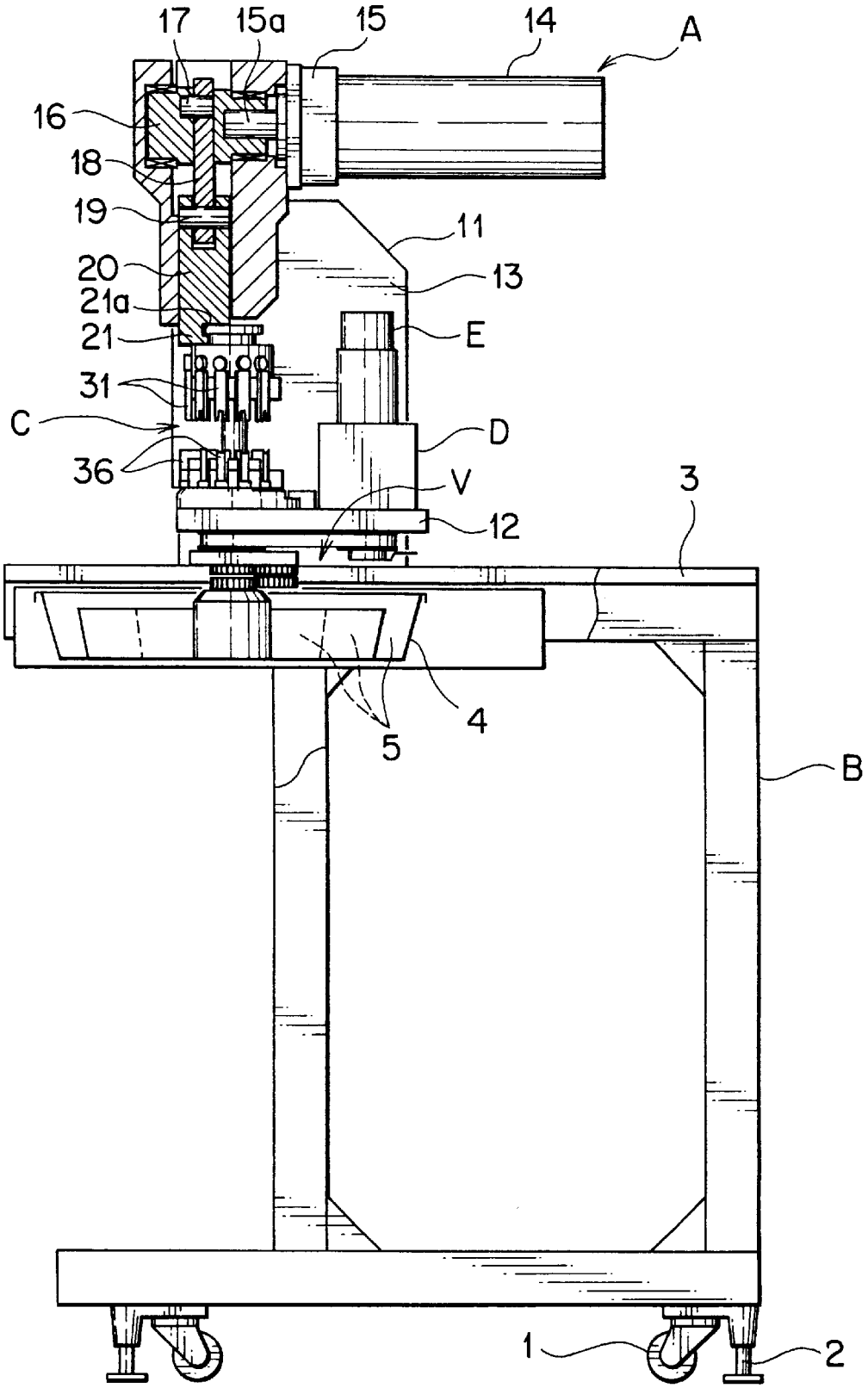
FIG. 2 is a side view of the machine shown in FIG. 1.
Figure 3:
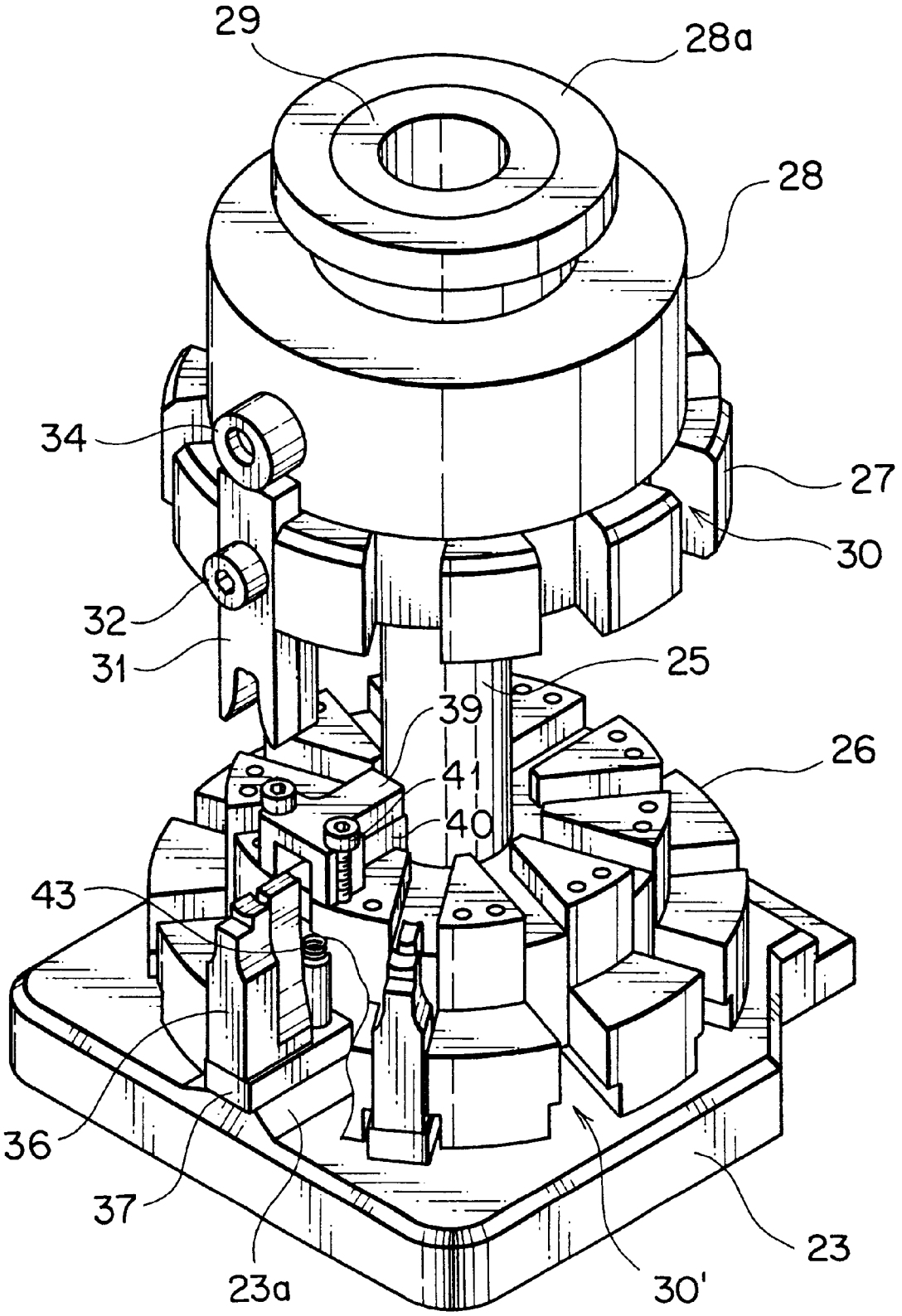
FIG. 3 is a perspective view of an applicator section of the machine shown in FIG. 1.
Figure 4:
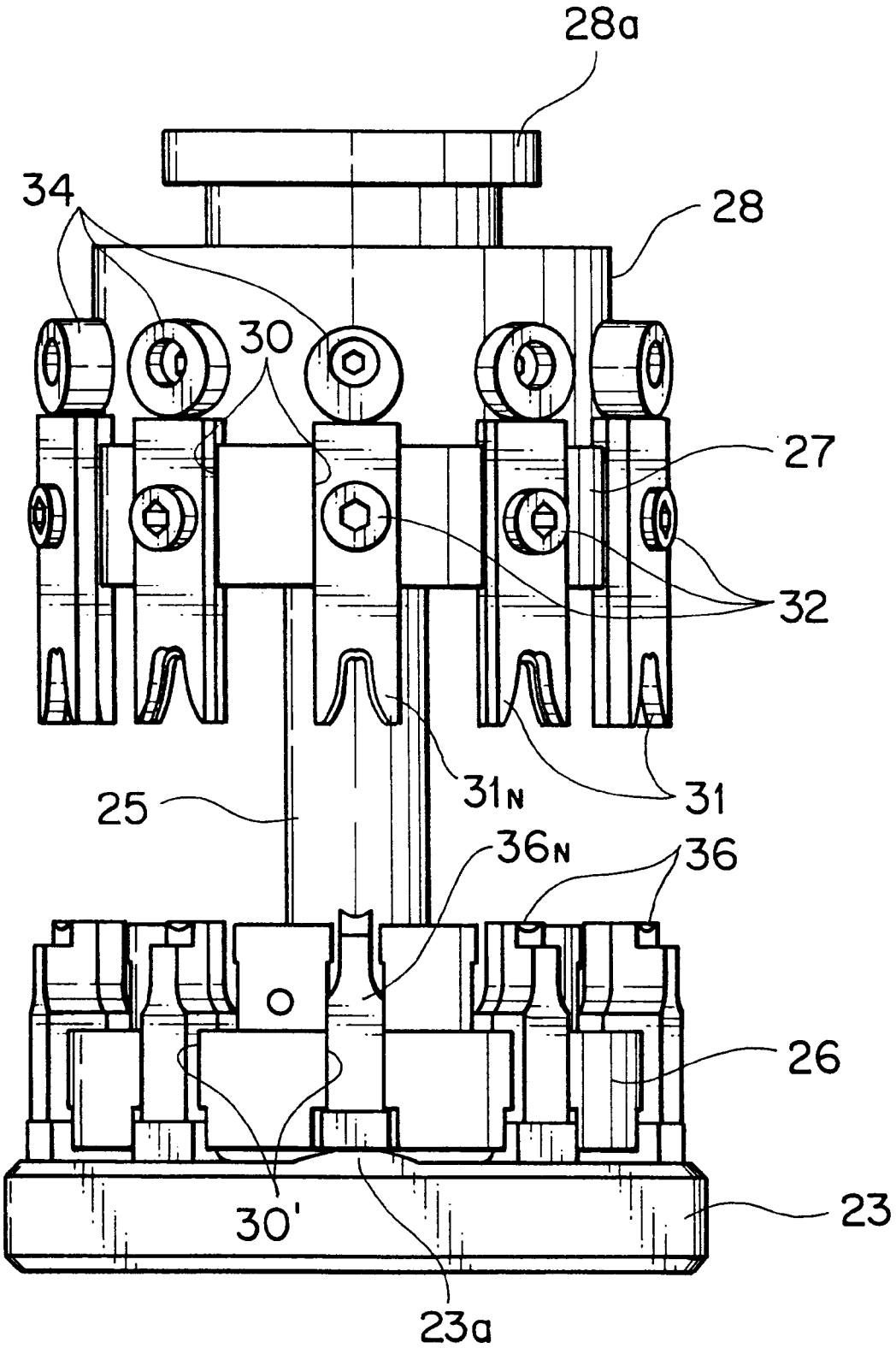
FIG. 4 is the enlarged front view of the applicator section shown in FIG. 3.

In FIGS. 1 and 2, denoted A is a terminal crimping machine; B a base frame. The terminal crimping machine A is mounted on a bed plate 3 of the base frame B having casters 1 and screw-jack-type stoppers 2. Just under a lower surface of the bed plate 3 is rotatively attached a circular terminal accommodating box 4 to a support shaft 58 that will be discussed later.

The terminal crimping machine includes a support frame 11 having a base plate 12 and a pair of side plates 13, the base plate 12 having a space V above the bed plate 3. Above the pair of side plates 13 is mounted a servo-motor 14 rearward extending from the support frame 11. A reduction gear 15 for the motor has an output shaft 15*a* fitted with a circular plate 16. The circular plate 16 has an eccentric pin 17 (a crank shaft). The eccentric pin 17 slidably connects to an upper end of a pivoting crank rod 18, a lower end of the crank rod 18; is pivotably attached to a pressing ram 20 by way of a pin 19. The pressing ram 20 has a hook-shaped portion 21 near a lower surface thereof, the portion 21 having a horizontal groove 21*a*. Further, the ram 20 is vertically slidably inserted in ram guides 22, 22 extending from an inner surface of each side plate 13.

Meanwhile, on the base plate 12 of the support frame 11 is mounted an applicator section C in the front middle thereof and a rotation source section D in the rear thereof. The applicator section C has a plurality of crimpers 31 and anvils 36 that are radially arranged therein. A control device E outputs signals for selecting a desired pair of a crimper 31 and an anvil 36 to locate them at the front center of the machine shown in FIG. 1.

As shown in FIGS. 3 to 6, the applicator section C has a fitting plate 23 to which a rotation shaft 25 is vertically inserted by way of a bearing 24. The rotation shaft 25 is attached with a lower rotating base disc 26 at a lower end thereof, and is attached with a vertically sliding, upper rotating base disc 27 and a shank 28 by way of a cylindrical spline 29 with bearing balls at an upper end thereof. At a top of the shank 28 is formed with a flange 28*a* engaging with the hook portion 21 of the pressing ram 20.

The upper rotating base disc 27 has a plurality of (ten in the shown example) channels 30 for attaching crimpers and radially extending at predetermined angles. Each channel 30 is mounted with a crimper 31 comprising an outer crimping piece 31*a* and a wire crimping piece 31*b* that are secured by a bolt 32. Further, in an outer surface of the shank 28 is formed with a dial fitting hole 33 with a bolt hole 33*a* relating to the respective crimper mounting channel 30. In each dial fitting hole 33 is fitted a crimping-height adjusting dial 34 abutting against the outer crimping piece 31*a* at a lower end thereof with a bolt 35. Thereby, turning the dial 34 can adjust crimp height of the outer crimping piece 31*a*.

Meanwhile, the lower rotating base disc 26 has a plurality of anvil fitting channels 30' in the same directions as the crimper fitting channels 30 of the upper rotating base disc 27. Each groove 30' has been mounted with an anvil 36.

That is, the lower rotating base disc 26 has a boss 26*a* projecting downward from a bottom surface thereof. Further, in a recess 26*b* formed between the boss 26*a* and the bottom thereof is mounted with an anvil fitting block 37 with a block securing shaft 38. Each block 37 is secured to the anvil 36 respectively for the anvil fitting grooves. Moreover, on an upper surface of the lower rotating base disc 26 is fitted first and second terminal holders 39 and 40 with a bolt 41 for each anvil 36.

The first terminal holder 39 serves as a stopper for a striped end of an electrical wire, on crimping, together with fore end, longitudinal guide portions of the terminal fitting. The second terminal holder 40 serves as another stopper for positioning the terminal fitting in the axial direction. Further, the second holder 40 is biased toward the anvil 36 by a ball-screw-type plunger 42. The plunger 42 enables minute movement of the second holder 40 toward the rotation shaft 25, absorbing an axial extension of the terminal fitting during terminal crimping.

Further, the block 37 for fitting the anvil is biased toward the mounting plate 23 by a spring 43, eliminating bumpy movement of the anvil 36 and allowing stable crimping of the anvil 36 and crimper 31.

Moreover, on the fitting plate 23 in the applicator section C is formed a protruded, anvil supporting seat 23*a* at the crimping position, selectively lifting and supporting one of the anvils 36 to be prepared for crimping and enabling smooth rotation of the lower rotation base disc 26 and the pieces thereon.

The rotation source section D has a servo-motor 45 and a rotation delivering mechanism with a timing belt and a jointing shaft.

That is, on the base plate 12 is mounted the servo-motor 45, that can rotate normally and reversely, in the rear of the applicator section C. Further, an output shaft 45*a* of the motor 45 extends downward through the base plate 12 and joints to a jointing shaft 49 by way of a timing pulley 46, a timing belt 47, and another timing pulley 48.

The jointing shaft 49 consists of an upper jointing shaft 49*a* and a lower jointing shaft 49*b* that are connected together with a parallel pin. The shaft 49 is rotatively supported by bearings $\mathbf{55}_1$, $\mathbf{55}_2$ between the base plate 12 and a bearing fitting plate 54. The bearing fitting plate 54 is positioned under the plate 12 with a spacer 52 therebetween and is secured to the plate 12 by a plurality of bolts 53. Further, the upper jointing shaft 49*a* is biased upward by a spring 51, and a key portion 49*a*1 projecting from the top of the shaft 49*a* engages with an engaging portion 25*a* formed in the rotation shaft 25. Moreover, the timing pulley 48 is axially attached to an outer connecting surface each of the jointing shafts 49*a* and 49*b*.

Moreover, between the bearing fitting plate 54 and the base plate 12 is a driven shaft 56 is rotatively disposed by way of bearings $\mathbf{55}_3\mathbf{3}$ and $\mathbf{55}_4$. The output of the servo-motor 45 is delivered to the driven shaft 56 by way of the jointing shaft 49 and gears $\mathbf{57}_4\mathbf{1}$, $\mathbf{57}_2$. Further, the driven shaft 56 rotatively connects to a support shaft 58 in the terminal receiving box 4 with gears $\mathbf{57}_3$ and $\mathbf{57}_4$. The terminal receiving box 4 includes a plurality of terminal receiving chambers 5 radially extending around the support shaft 58 corresponding to the plural pairs of the crimpers 31 and the anvils 36.

Besides, the drive shaft 45*a* of the servo-motor 45 is fitted with the timing pulley 46 by way of a bush 59, and on a lower end of the bush 59 is mounted an angle detecting plate 60.

Referring to terminal crimping in the above-mentioned arrangement, pushing a switch button in a switch box (not shown) provided in the base frame B starts rotation of the servo-motor 45 that rotates normally or reversely by signals from a control device E. The timing belt and jointing shaft mechanism rotates the rotation shaft 25, causing a desired pair of a crimper 31N and an anvil 36N, for example, to be oriented and positioned at the front center in FIG. 4.

Figure 5:
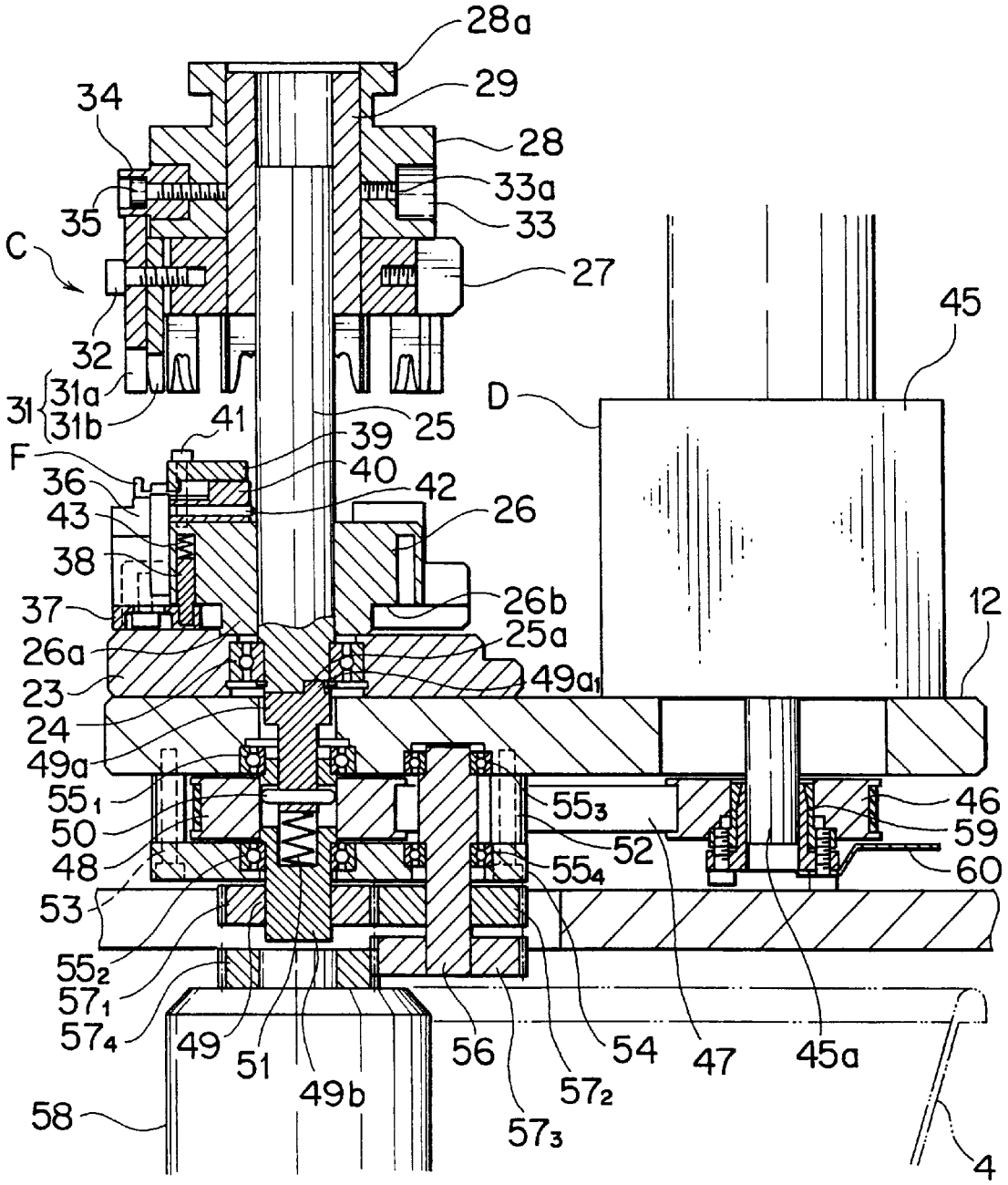
FIG. 5 is a sectional side view of major parts in the applicator section shown in FIG. 3.
Figure 6:
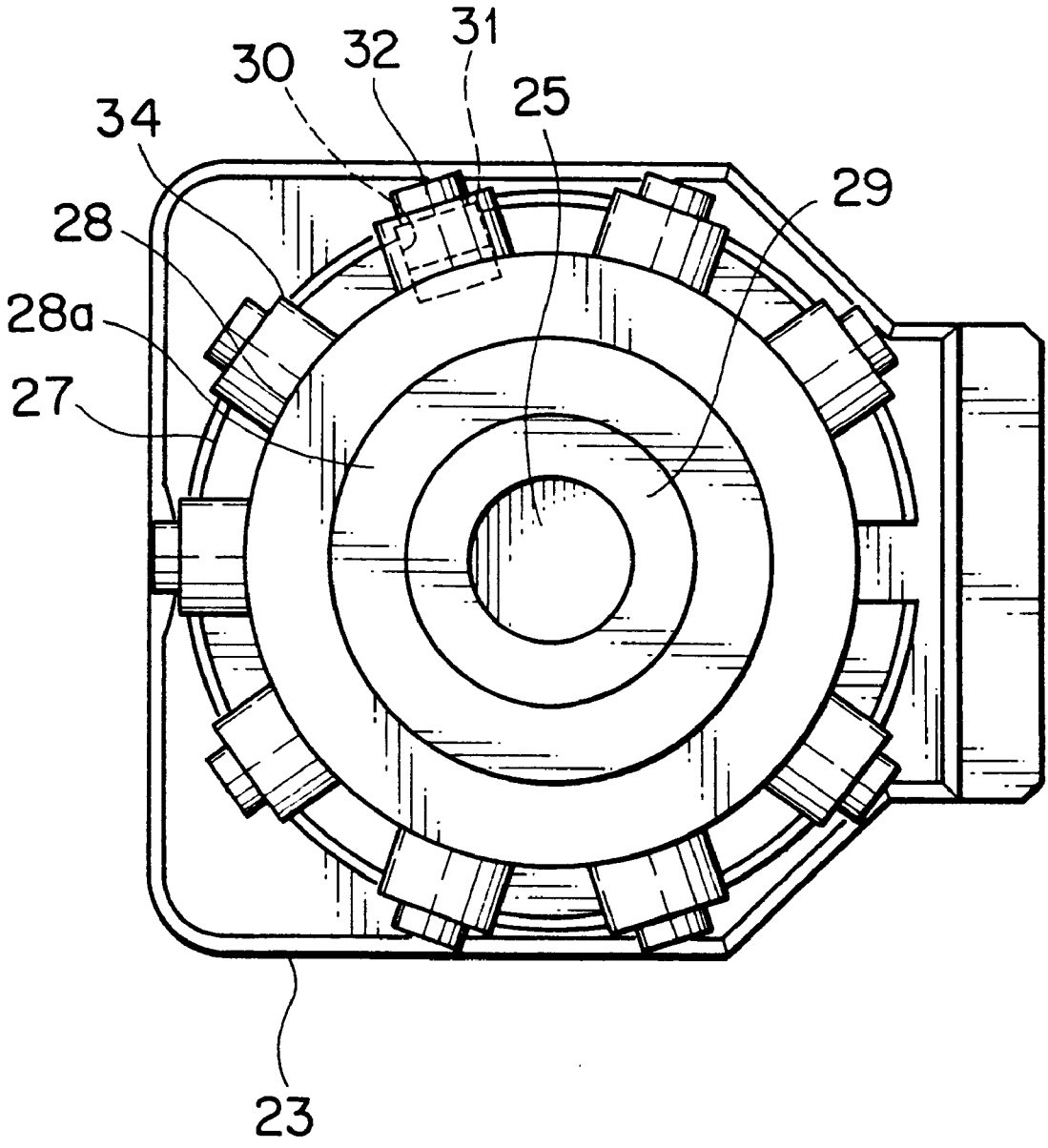
FIG. 6 is a top view of the applicator section shown in FIG. 4.

Then, an operator, as shown in FIG. 5, puts a terminal fitting F on the anvil 36, sets a stripped end of an electrical wire, and pushes a foot switch (these are not shown). Thereby, the servo-motor 14 rotates normally or reversely, causing the crimper 31N to be vertically moved toward or from the anvil 36N for crimping the terminal fitting F by way of the reduction gear 15, the circular plate 16, the crank arm 18, and the pressing ram 20.

The selected crimper 31N and the anvil 36N is correctly positioned. That is, with the rotation of the servo-motor 45, the rotation shaft 25 rotates synchronously with the drive shaft 45*a*. Therefore, the angle detecting plate 60 fitted to the drive shaft 45*a* always can read out a rotation angle from a the reference line. An output signal based on the red-out angle allows the correct positioning of the crimper and anvil trough the control device E.

Besides, in the terminal crimping machine A, the pressing ram 20 can give pressure just downward to the selected crimper 31N as definitely shown in FIGS. 2 and 5. That is, the pressure acting direction aligns substantially with the central axis of the crimper 31, which resulting an improvement in efficiency. Further, almost no bending moment is acted on the crimper 31, eliminating deformation of the crimper 31.

Thus, the terminal crimping machine A according the invention has the single rotation shaft 25 supporting the upper and lower rotating base discs 27, 26. On the base discs are mounted the plurality pairs of crimpers 31 and anvils 36, each pairs radially orienting in the same direction. The pressing ram 20 and the shank 28 are common to each crimper 31, and the single servo-motor 14 is used for moving up and down the plurality of the crimpers 31.

Consequently, though the terminal crimping machine A has the plural pairs of crimpers 31 and anvils 36, the structure is simple and compact, requiring no large installation space.

Moreover, the terminal receiving box 4 disposed under the bed plate 3 rotates synchronously with the rotation shaft 25, the jointing shaft 49, the gears $\mathbf{57}_1$ and $\mathbf{57}_2$, the driven shaft 56, the gears $\mathbf{57}_3$ and $\mathbf{57}_4$, and the support shaft 58. When the selected crimper 31N and anvil 36N stop at the position for crimping operation, the terminal receiving box 4 that also stops under the anvil has the terminal fitting F corresponding to the terminal receiving chamber 5. This allows correct preparation and use of terminal fittings.

Figure 7B:
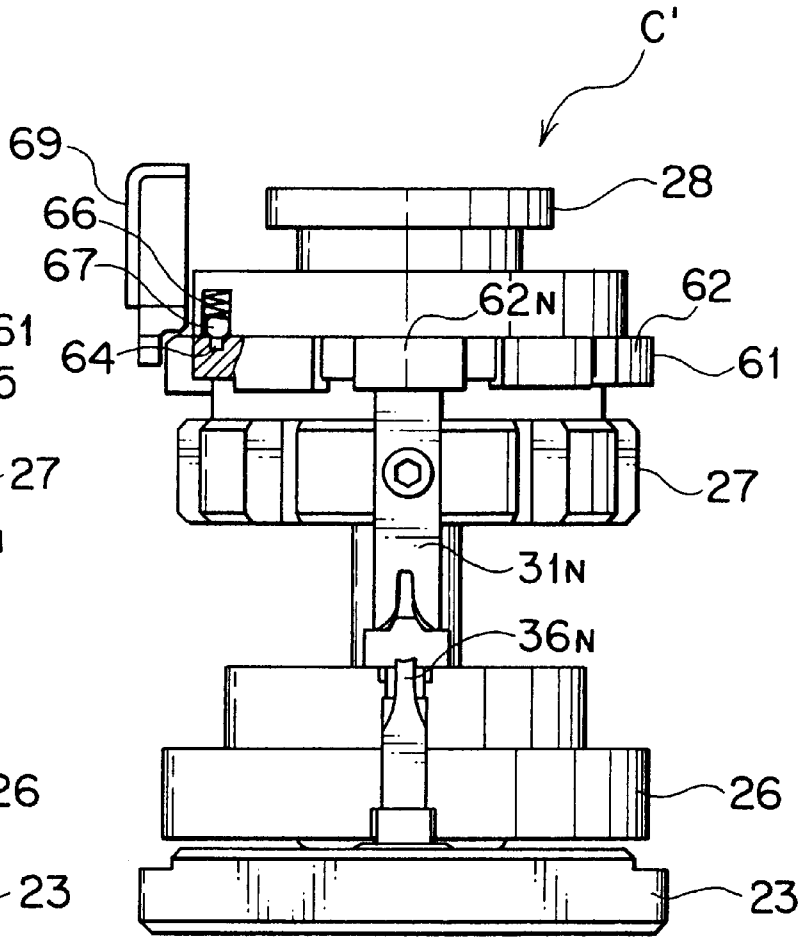
FIGS. 7A and 7B are the front views showing an applicator section of another embodiment according to the invention, in which an adjusting disc has been restricted in FIG. 7A and released in FIG. 7B.
Figure 7A:
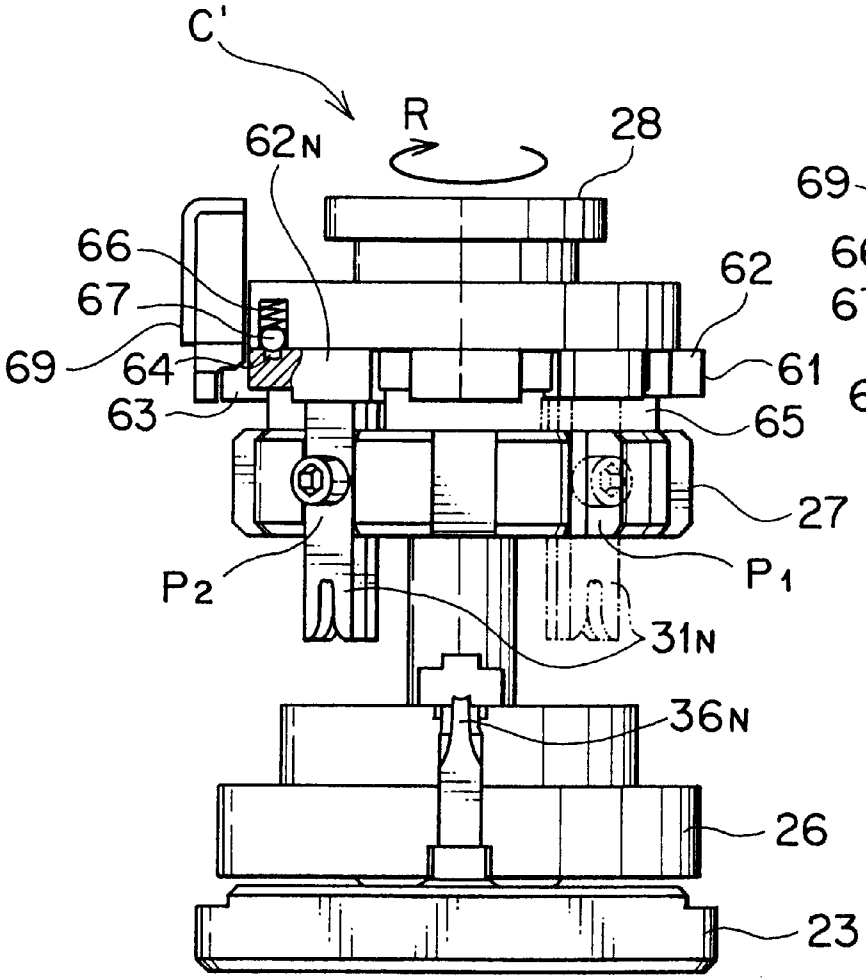
Figure 8:
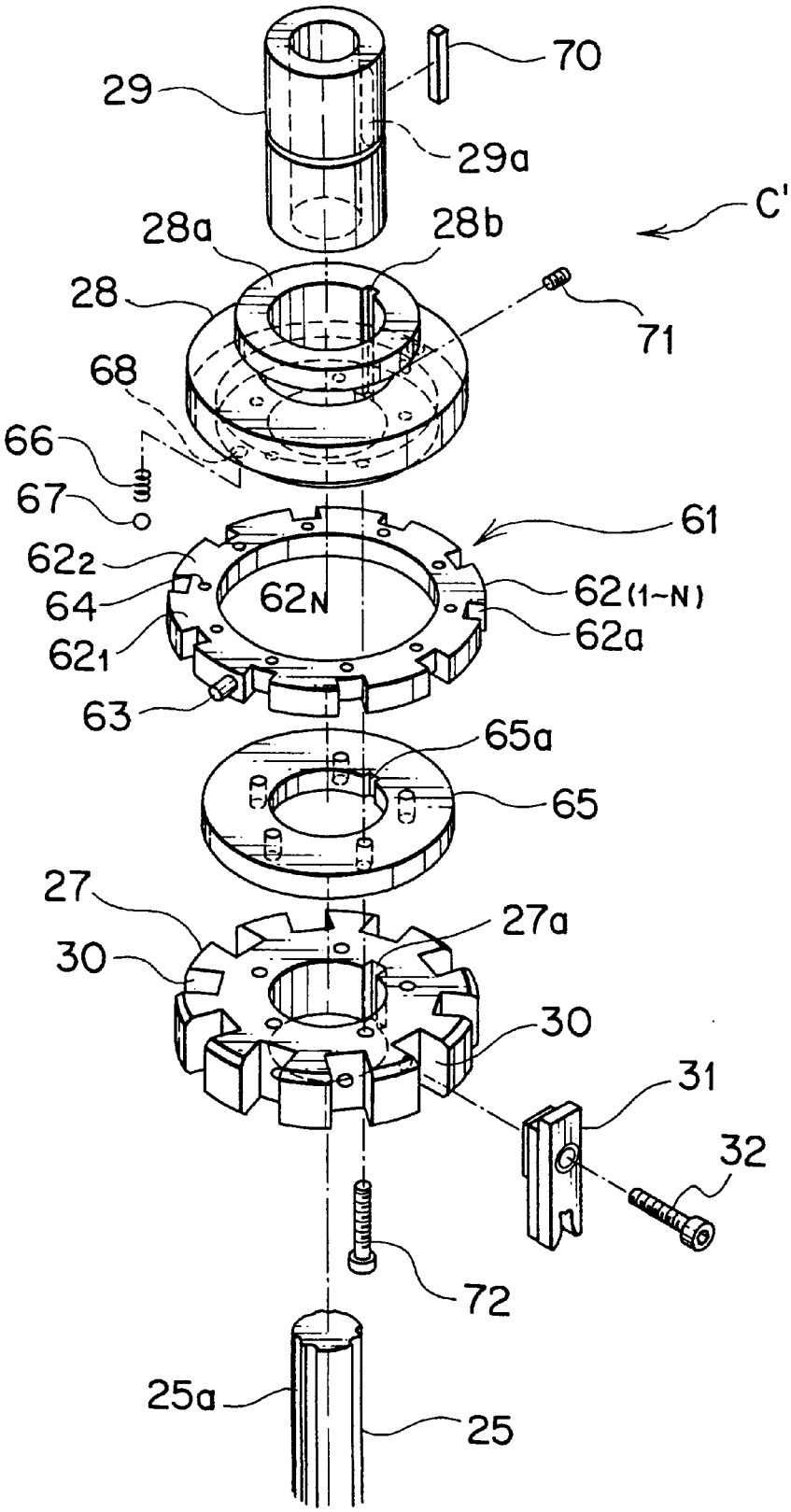
FIG. 8 is an exploded perspective view of major parts in the applicator section shown in FIG. 7.
Figure 9:
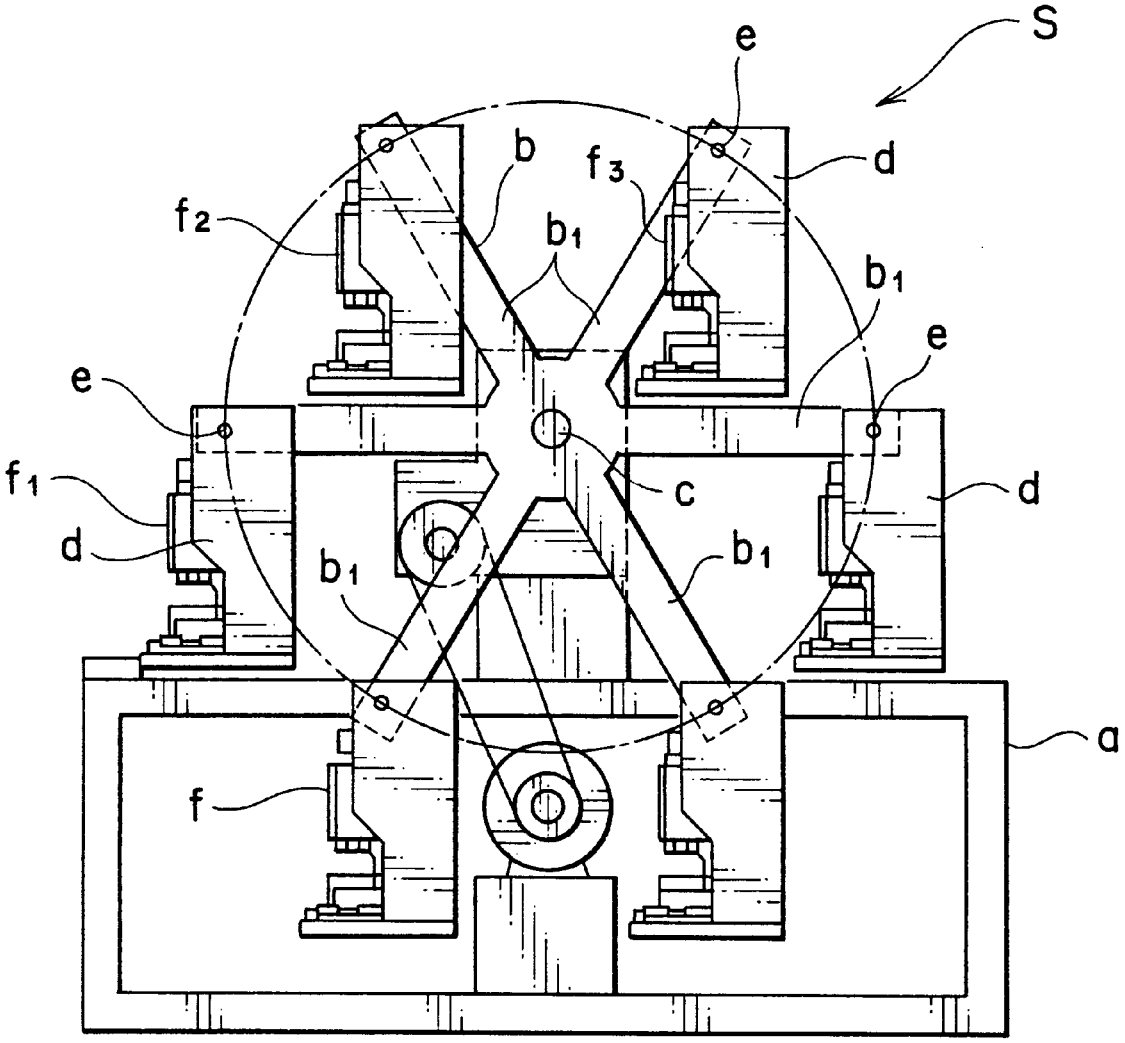
FIG. 9 PRIOR ART
FIG. 9 is a side view showing basic parts of a known crimping applicator apparatus with plural cradles.
Figure 10:
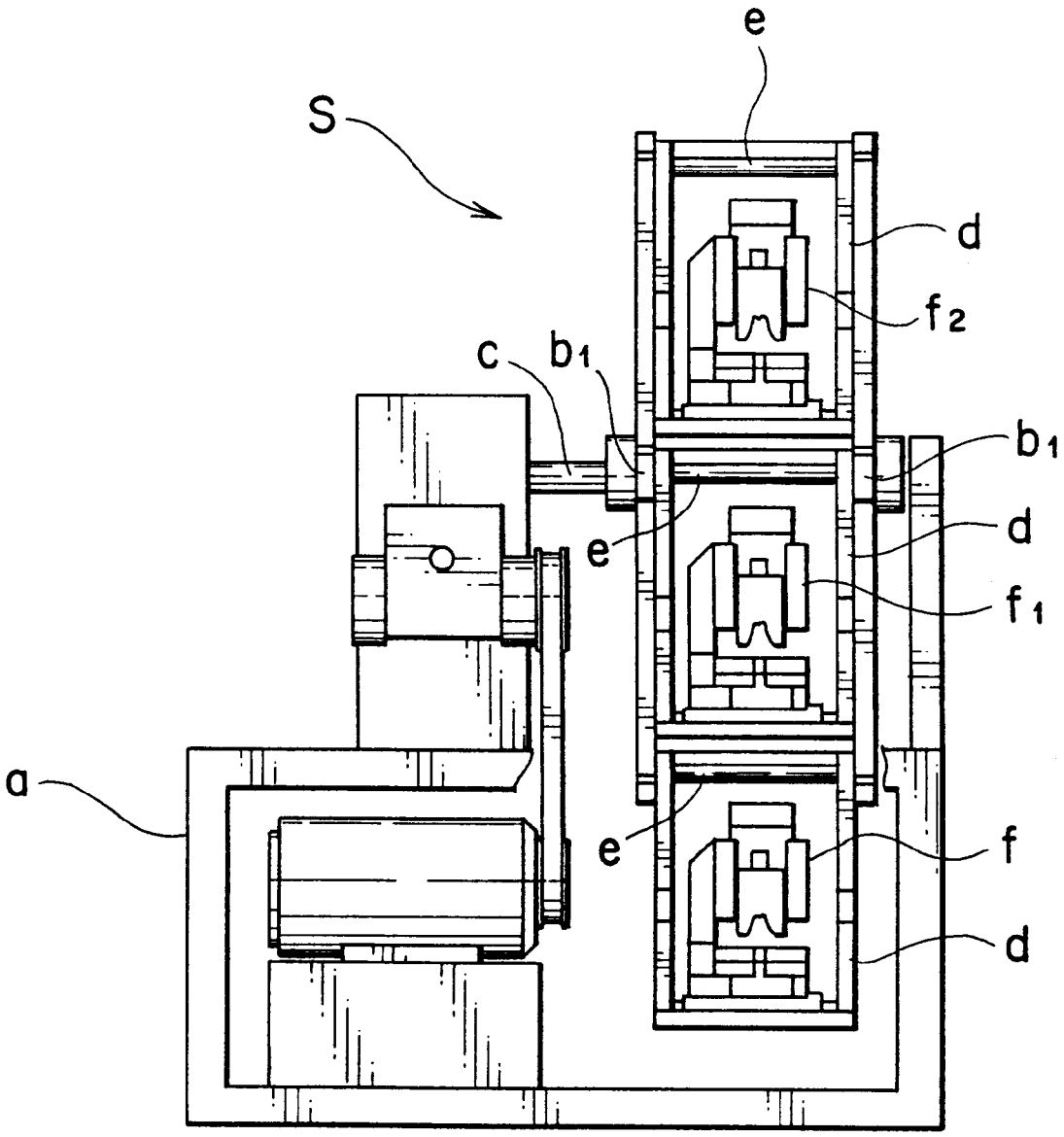
FIG. 10 PRIOR ART
FIG. 10 is the front view of the apparatus shown in FIG.

FIGS. 7A, 7B, and 8 show means for vertically positioning the outer crimper 31*a* in place of the adjustment dial 34.

That is, FIGS. 7A and 7B are the front views of an applicator section C' in another embodiment of the invention. FIG. 7A shows a locked state of an adjustment disc for adjusting the outer crimper 31*a* in vertical position; FIG. 7B a released state. FIG. 8 is an exploded perspective view of major parts of the applicator section shown in FIG. 7.

In FIGS. 7A and 7B, the applicator section C' has the rotation shaft 25. At upper end of the rotation shaft and between the shank 28 and the upper rotating base disc 27, a crimper adjusting disc 61 and its washer 65 are axially attached. The disc 61 can intermittently rotate to the shank 28 by a click-stop mechanism, and the washer 65 is secured to an upper rotating base disc 27. Further, on an outer surface of the adjusting disc 61 there is provided a rotation preventing key 69.

That is, the adjusting disc 61, as shown in FIG. 8, has a plurality of height adjusting bosses $\mathbf{62}_1$, $\mathbf{62}_2$, . . . , and 62N radially extending at predetermined intervals with a channel 62*a* therebetween. Further, on an outer surface of the disc 61 is projecting a stop pin 63 for preventing rotation of the disc 61. The bosses 62L to 62N have respective sequentially different thicknesses for minutely changing the initial vertical position of the crimper 31*a* before crimping, for example, the difference being 0.03 mm. In the embodiment shown in FIG. 8, the thicknesses increase clockwise.

Moreover, in an upper surface of the adjusting disc 61 are formed a plurality of receiving channels 64 relating to a ball 67 discussed later, composing the click-stop mechanism. Meanwhile, in a lower surface of on the shank 28 opposing to the adjusting disc 61 is formed a spring receiving recess 68 for a spring 66 to resiliently bias the ball 67.

Referring to the above-mentioned applicator section C and FIG. 8, on an outer surface of an upper end of the rotation shaft 25 are formed a plurality of guiding ridges 25*a*. These guiding ridge 25*a* allows the cylindrical spline 29 to be attached to the rotation shaft 25 slidably in the axial direction but not rotatively around the shaft. The cylindrical spline 29 has a vertical elongated key groove 29*a* in an outer surface thereof for receiving a key 70. Further, the shank 28, the washer 65, and the upper rotating base disc 27 are respectively formed with key grooves 28*b*, 65*a*, and 27*a* relating to the key 70. This engagement causes that the shank 28, the washer 65, and the upper rotating base disc 27 are restricted in rotation to the cylindrical spline 29; further, a set screw 72 combines the three members for united movement. Designated 71 is a stopper screw for the key 70.

Meanwhile, the adjusting disc 61 is rotatively attached to the cylindrical spline 29 between the shank 28 and the washer 65, and a click-stop mechanism is applied between the disc 61 and the shank 28. That is, the ball 67 downwardly resiliently biased by the spring 66 received in the recess 68 in the lower surface of the shank 28 engages with a receiving channel 64*b* of the adjusting disc 61. Thus, the adjusting disc 61 rotates dependently with the shank 28, if there is no restriction for the rotation.

Next, initial vertical height adjustment of the outer crimper 31*a* by the adjusting disc 61 will be discussed.

Referring to FIG. 7A, the shank 28 is at the highest position (corresponding to the upper dead center of the ram 20 in FIG. 2), the adjusting disc 61 can neither rotate clockwise nor counterclockwise, because the stop pin 63 has engaged with the rotation preventing key 69. Further, a crimper 31N and an anvil 36N that will be used in the next terminal crimping operation is at the position P1 (in the right on FIG. 7A) illustrated by an imaginary line.

In this state, if the adjusting boss 62N for restricting the initial height of the crimper 31N is positioned at a point P2 shown in the left on the figure, the crimper 31N shown by a continuous line and the anvil 36N are is positioned at he point P2 by rotating the upper and lower rotating base discs 27, 26 in a direction shown by an arrow head R. The rotation of the discs 27, 26 with the shank 28 can be accomplished by rotating the rotation shaft 25 driven by the servo-motor 45.

Then, the shank 28 is moved a little downward from the highest position by rotating the servo-motor 14 that is mainly used for vertical moving the crimper 31 as shown in FIG. 7B. This releases the rotation preventing key 69 from the stopper pin 63.

Next, rotating the rotation shaft 25 in the reverse direction to the arrow head R can move the selected crimper 31N, the anvil 36N, and the adjusting boss 62N to align with the front center in FIG. 7B for the next terminal crimping operation. It is noted that the adjusting disc 61 can rotate together with the shank 28 by way of the click-stop mechanism in the positioning thereof.

As described above, the latter embodiment has the adjusting disc 61 with the plurality of radially extending adjusting bosses $\mathbf{62}_1$, $\mathbf{62}_2$, . . . , and 62N. Further, the click-stop mechanism has been utilized between the adjusting disc 61 and the shank 28. Thus, selection of the most desirable initial height of the crimper 31 for a type of terminal is automatically accomplished by using the servo-motor 45 and the servo-motor 41 vertically moving the crimper 31. In other words, the selection can be done at the same time as the automatic operation of the applicator C'. This eliminates hand operation of the adjustment dial 34 relating to the applicator C in the former embodiment, enabling a more precise adjustment of crimp height.

What is claimed is:

1. A multiple-terminal crimping machine, comprising:

a pressing ram having a hook-shaped portion at a lower end thereof;

a crimper and an anvil for cooperatively crimping a stripped wire end to a terminal, said crimper being movable up and down by said pressing ram, said anvil being positioned opposite to said crimper;

a base frame for supporting said crimping machine;

a vertical rotation shaft rotatably supported on said base frame, said vertical rotation shaft having a lower end portion and an upper end portion;

a lower rotating base disc secured on said lower end portion of said rotation shaft;

a cylindrical spline slidably rotatable fitted on said upper end portion of said vertical rotation shaft, said cylindrical spline having an outer surface;

a shank secured on said outer surface of said cylindrical spline, said shank having an upper end portion;

an upper rotating base disc secured on said outer surface of said cylindrical spline; and a flange formed at said upper end portion of said shank and engaged with said hook-shaped portion of said pressing ram, wherein each of said lower rotating base disc and said upper rotating base disc is, at an outer peripheral portion thereof, provided with a plurality of radially inwardly dented fitting channels, and wherein said crimper is detachably mounted in one of said channels of said upper rotating base disc, and said anvil is detachably mounted in one of said channels of said lower rotating base disc.

2. The crimping machine as claimed in claim 1, further comprising an adjusting dial for adjusting crimp height of said crimper, said adjusting dial being provided in said outer surface of said shank.

3. The crimping machine as claimed in claim 1, further comprising an adjusting disc for adjusting crimp height of said crimper said adjusting disc being fitted on said vertical rotation shaft between said shank and said upper rotating base disc by way of said cylindrical spline so as to intermittently rotate around said vertical rotation shaft and having a plurality of position adjusting bosses radially outwardly formed on an outer periphery thereof, said adjusting disc also having a rotation stopper, wherein said shank has a rotation preventing key engaging with said stopper when said shank is lifted, and wherein said adjusting disc is able to rotate together with said upper rotating base disc when said shank is lowered from the lifted position by the downward movement of said pressing ram so that said stopper can be released from said rotation preventing key.

4. The crimping machine as claimed in claim 1, wherein each of said anvils secured on said lower rotating base disc has first and second terminal guides for a terminal fitting.

5. The crimping machine as claimed in claim 1, wherein said base frame has a base plate with a space thereunder and a pair of side plates, a bearing fitting plate disposed under said base plate and a jointing shaft rotatively provided between said base plate and said bearing fitting plate and being connected to a servo-motor output shaft by way of a timing belt, and an upper end of said jointing shaft is connected to said lower end portion of said vertical rotation shaft by a jointing key.

6. The crimping machine as claimed in claim 5, wherein said jointing shaft comprises an upper jointing shaft body and a lower jointing shaft body that are jointed by way of a parallel pin, said upper jointing shaft body being biased by a spring toward said vertical rotating shaft.

7. The crimping machine as claimed in claim 5, further comprising a driven shaft extending downward from said bearing fitting plate, said driven shaft being rotatable supported by said bearing fitting plate and said base plate wherein said driven shaft connects to a supporting shaft for supporting a terminal accommodating box by way of a gear and wherein said terminal accommodating box has a plurality of radially extending terminal receiving chambers corresponding to a plurality of crimpers and anvils.

8. The crimping machine as claimed in claim 5, wherein said servo-motor output shaft for rotating said vertical rotation shaft has a rotation angle detecting plate for detecting a rotated angle from a base line regarding each of said plurality of crimpers and anvils to serve as a rotation angle detecting shaft driving a driven shaft.

9. The crimping machine as claimed in claim 1, wherein said cylindrical spline has bearing balls therein.

10. The crimping machine as claimed in claim 3, wherein said adjusting disc can intermittently rotate around said cylindrical rotation shaft by way of a click-stop mechanism so that said bosses can stop to align with each of said crimpers.

* * * * *